US005215481A

United States Patent [19]

Leisey

[11] Patent Number: 5,215,481

[45] Date of Patent: Jun. 1, 1993

[54] TORSION TUBE ELECTRICAL CONNECTORS

[76] Inventor: Donald R. Leisey, 8142 Jefferson St., Hummelstown, Pa. 17036

[21] Appl. No.: 807,158

[22] Filed: Dec. 13, 1991

[51] Int. Cl.[5] ..... H01R 13/00

[52] U.S. Cl. ..... 439/851

[58] Field of Search ..... 439/842, 851, 856, 857, 439/861, 862

[56] References Cited

U.S. PATENT DOCUMENTS

| | | | |
|---|---|---|---|
| 2,924,807 | 2/1960 | Field . | |
| 3,362,008 | 1/1968 | Berg | 439/851 |
| 3,786,401 | 1/1974 | Jones et al. | 439/851 |
| 3,815,081 | 6/1974 | Jones | 439/851 |
| 4,105,277 | 8/1978 | Jacobs . | |
| 4,735,588 | 4/1988 | Bird et al. . | |
| 4,874,338 | 10/1989 | Bakermans | 439/851 |
| 4,941,853 | 7/1990 | Harwath . | |

FOREIGN PATENT DOCUMENTS 2589933 5/1987 France .

*Primary Examiner*—Joseph H. McGlynn
*Attorney, Agent, or Firm*—Gerald Post

[57] ABSTRACT

An electrical connector contacts assembly having a solid elongated pin member and a hollow socket member each having like cross-sections for closely removably inserting the pin through the socket. The socket body is twisted into a helical configuration while the pin is straight-sided. The assembly of the members reconfigures the more resiliant socket into the configuration of the pin setting up torsional stresses that create a uniformly distributed torsional force load between the pin and socket for achieving low electrical resistance therebetween.

2 Claims, 1 Drawing Sheet

"L"
"L"

TORSION TUBE ELECTRICAL CONNECTORS

BACKGROUND OF INVENTION

1. Field of the Invention

The present invention is directed to the field of electrical connector contacts or terminals and connector assemblies and in particular of the type having contact forces caused by torsional loading of the contact terminals.

2. Description of the Prior Art

The contact forces between the components of a mating pair of electrical connectors is of paramount importance in forming a reliable connection. This contact force is usually derived from the elastic characteristics of either or both of the connector terminal members.

Many contact designs utilize the principle of bending one or more terminal fingers that are configured as cantilevered beams. The bending forces give rise to a contact force between the terminals. Relatively high flexure of the beam is required to assure sufficient force thereby resulting in high bending stresses. This construction, along with the clearance needed to accommodate the flexing of the contact, precludes close contact spacing in a multi-contact assembly having high density connectors or multiple connectors in a confined space. With the continuing trend toward miniaturization, it becomes difficult and expensive to manufacture flexing beam systems that give satisfactory performance.

Terminals have been designed that develop torsional loads for creating contact forces between connector terminals. Torsional loading by means of rotation of a terminal about its own longitudinal axis allows for a compact design. Some prior art devices that teach this type of construction include U.S. Pat. No. 4,941,853 to Harwath; U.S. Pat. No. 4,105,277 to Jacobs; U.S. Pat. No. 2,924,807 to Field; and U.S. Pat. No. 4,735,588 to Bird et al. None of these devices discloses a construction where the socket or female member of the contact pair deforms. It is rather the pin or male member that is forced into conformance with the socket and as a result insertion forces are frequently unacceptably high with a consequent low cycle life because of degradation of the contact surfaces.

SUMMARY OF THE INVENTION

The present invention overcomes the limitations of the prior art. It is the principle object of this invention to provide an electrical connector assembly capable of maintaining sufficient contact forces for achieving low electrical resistance while maintaining contact integrity under severe shock and vibration environments and repeated connection and disconnection.

A further object of the invention is to have the contact forces uniformly distributed along the mating length of the socket material.

A still further object is to provide pairs of terminals that can be positioned at close center distance between rows and columns with respect to an adjacent pair mounted in an insulator housing thereby forming a multi-pin high density connector.

A still further object is to provide a socket or female terminal connectable with the pin of an existing connector, header or pin field of a printed circuit board.

These and other objects are achieved by the preferred embodiment of the present disclosure which comprises an elongated pin or male terminal member having a cross-section configured as a multisurfaced polygon, but preferably a square, that is to be inserted into a socket or female terminal member to complete an electrical circuit. While the pin is a solid member having straight and planar surfaces, the socket is fashioned by bending thin sheet metal into an interrupted hollow tube to form a passageway, the interior of which is congruent to the polygonal shape of the pin and receivable of the pin for its full length thereby defining a mating length where the pin and socket are overlapping.

The passageway is not a straight tunnel but rather a progressively rotated or twisted shape where each adjacent section is angularly skewed from the previous section thereby forming a helix having its axis coincident with the longitudinal axis of the passageway. Furthermore, one of the walls making up the passageway is slit longitudinally for the full mating length.

In another embodiment, the passageway is straight with parallel planar walls and the pin member is progressively angularly skewed, but in either embodiment, the cross-section of the passageway has a gradual and continuous angular orientation differing from that of the pin. When the pin and socket are mated, cooperating portions of each cross-section are in contact and complete an electrical circuit therethrough.

Insertion of the pin into the socket forces the socket to counter-rotate or untwist from its helical configuration to match the constancy of the pin since the pin is formed from a more rigid solid cross-section of metal while the socket is formed from thin sheet metal. This torsional loading is uniformly distributed along the length of the socket and with proper design, would be fully contained within the socket and pin and having no external torsional forces beyond the limits of the mating length of the coupled assembly. In order to limit the torsional resistance of the socket to the pin, one surface of the passageway is slit. This slit which may have the adjacent edges in contact or have a finite gap there between, allows the passageway to conform to the pin cross-section while untwisting since a closed tube construction is unacceptably stiffer to torsional loading and will give rise to unnecessarily high insertion forces and unpredictable distortion.

Having in mind the above and other objects that will be obvious from an understanding of the disclosure, the present invention comprises a combination and arrangement of parts illustrated in the presently preferred embodiment of the invention which is herein set forth in sufficient detail to enable those persons skilled in the art to clearly understand the function, operation, construction and advantage of it when viewed in conjunction with the accompanying drawings.

BRIEF DESCRIPTION OF THE DRAWING

The invention will be described in detail, by way of example, with reference to the accompanying drawings in which.

DETAILED DESCRIPTION OF THE PREFERRED EMBODIMENTS

Figures 1, 2, 3, 4, 5, 6, 7, 8:
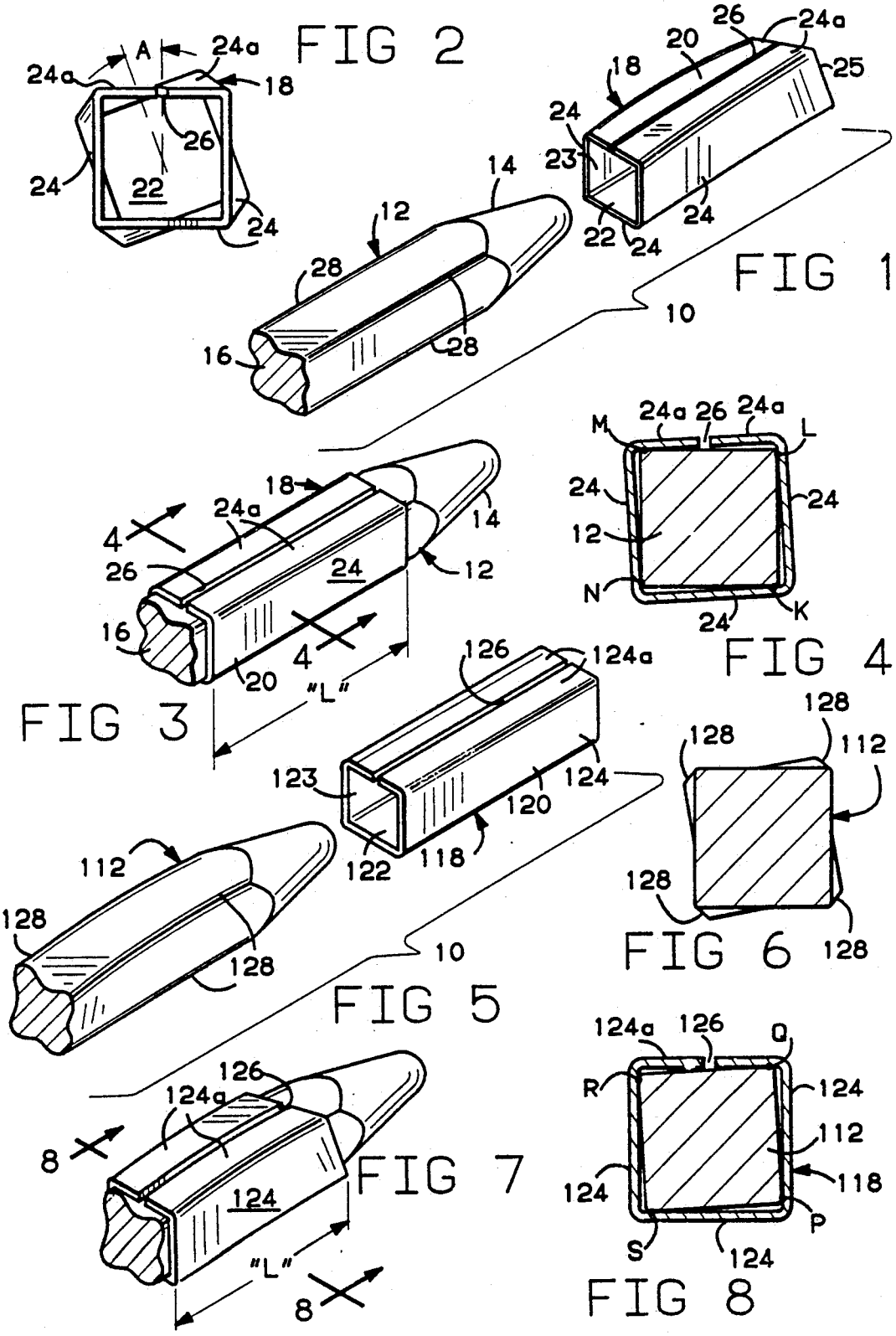
FIG. 1 is a pictorial view of the connector.
FIG. 2 is an end view of the socket member.
FIG. 3 is a pictorial view of the mated contact members.
FIG. 4 is a sectional view of the mated contact members taken along line 4—4 of FIG. 3.
FIG. 5 is a pictorial view of an alternative embodiment of the invention.
FIG. 6 is a cross-sectional view taken along line 6—6 in FIG. 5.
FIG. 7 is a pictorial view of the mated connectors of the alternative embodiment.
FIG. 8 is a sectional view taken along line 8—8 in FIG. 7.

Referring to FIG. 1 and 2 of the drawing and in accordance with the principles of the invention, an electrical connector assembly 10 without a housing is shown comprising a male or pin member 12 formed of electrically conductive material and shaped as an elongated prism having a polygonal cross-section that may be square, rectangular, triangular or other such geometrical shape with each of the surfaces thereof being planar. A tapered portion 14 is formed into the leading end of the pin 12 while the opposite end 16 would be configured for connecting with wires (not shown) or other conductors such as conductive traces on a printed circuit board for carrying electric current to or from the pin 12. The female or socket member 18 includes an elongated tubular body 20 having a cross-section matching that of the pin 12. The tubular body 20 forms a through passageway 22 having an opening 23 at one end while the opposite end 25 is also configured for attachment to conductor wires, printed circuit board traces or other elements. The passageway 22 is sized to allow the pin 12 to slide completely through in a close fitting connection. As shown in FIG. 2, the tubular body 20 is formed as a progressively skewed member with the skew axis coincident with the longitudinal axis of the tubular body 20. The passageway 22 takes on a helical configuration with each defining wall 24, 24*a* thereof similarly twisted. In FIG. 2, the angular twist A of the tubular body is apparent.

The tubular body 20 is not a continuous structure, but has an elongated slit 26 longitudinally parting any one wall 24*a*. The edges 26*a* defining the slit 26 may be abutting or have a finite gap between them. Entrance of the pin 12 through the opening 23 and along the length of the passageway 22 in the tubular body 20 and emerging from the opposite end 25 forms a mating assembly as shown in FIG. 3. The pin and socket overlap by the distance "L" defining the mating length. The insertion of the rigid pin 12 causes the deformable tubular body 20 to counter-rotate and change from a helical configuration to a generally straight prism conforming to the shape of the pin. The contact between the pin 12 and socket 18 falls along the corners 28 of the pin 12 and the inner surfaces of the walls 24, 24*a* of the passageway 22 as shown in FIG. 4 at K, L, M and N.

The significance of creating a torsional stress in the socket 18 is that the resulting contact stresses are distributed along the entire mating length L and will give rise to a uniform insertion force and sufficient contact force necessary for low contact resistance or good electrical conductivity as well as enough normal force for creating friction to maintain the engagement of the pin 12 and socket 18 to prevent separation under severe shock and vibration environments.

Unlike bending stresses which are maximum at the point of connection of a beam to a fixed portion of the terminal, torsional stresses are equally distributed along the full mating length L of the terminal socket member allowing the optimum condition for stress distribution. It is well known in the study of mechanics that a closed tube is extremely resistant to torsional deformation but an interrupted or partially closed tube, such as one with a longitudinal slit 26 can be twisted by the application of a lower insertion force. Of more significance is that the force applied to a closed tube will distort and warp all the walls 24, 24*a* while the incorporation of a slit 26 allows the walls 24, 24*a* to come to a near planar shape when counter-rotated or untwisted by the insertion of a straight and close fitting pin member 12 having a matching cross-section.

In an alternative embodiment shown in FIGS. 5 and 6, the pin member 112 is progressively skewed into a helical configuration about its longitudinal axis twisting each of the surfaces or faces thereof while the socket 118, including the interrupted tube member 120 and passageway 122 form a straight prism having walls 124 and 124*a* all perpendicular to the opening 123 at the front end. A slit 126, which may be closed or open as previously described, is also cut through any one of these walls 124*a*. Mating of the pin member 112 and the socket 118 by insertion of the tapered end 114 of the pin 112 into the opening 123 and through the passageway 122 places the straight socket 118 under torsional loading and causes it to rotate or twist and assume the helical configuration of the pin 112 as shown in FIG. 7.

As in the previous embodiment, the torsional load produced during the insertion of the pin 112 into the socket 118 would normally be passed through these members to their respective mounting points on the printed circuit boards or the like. If however, the entire socket member 118 were free to rotate about its longitudinal axis, no torsional effect would be felt at the pin mounting point.

Again, this torsional loading of the socket member generates distributed stresses along the mating length L thus creating contacts at points P, Q, R, and S along the edges 128 of the pin member 112 as shown in FIG. 8. The interruption in the perimeter of the tubular member 120 by the slit 126 makes it possible to achieve the described distributed stress loading and assure optimum electrical conductivity or low contact resistance and contact normal forces as does the first embodiment.

While the preferred embodiments of the invention are described, it will be understood that the invention is in no way limited by these embodiments.

What is claimed is:

1. In an electrical socket member slideably receptive of a cooperating elongated pin member for forming an electrical connector contact assembly, the improvement comprising:

said socket member constructed of deformable electrically conductive material configured as a tube open at both ends defining a passageway therethrough having a polygonal cross-section and having a plurality of wall members extending between said openings, wherein one of said wall members includes means defining a longitudinal slit along the full length thereof for reducing the torsional strength to an effectual value, and wherein said tube is twisted along its longitudinal axis therein providing said passageway with a helical configuration, wherein insertion of the pin, having a cross-section similar to that of the socket, into the passageway creates a gradual torsional deformation of said socket, therein developing contact forces between the corners of the pin and said wall members.

2. The socket as defined in claim 1 wherein the cross-section of said passageway is configured as a square.

* * * * *